US007954350B2

(12) United States Patent
Takahama et al.

(10) Patent No.: US 7,954,350 B2
(45) Date of Patent: Jun. 7, 2011

(54) METHOD OF SUPPLYING LUBRICATION OIL IN COLD ROLLING

(75) Inventors: Yoshiki Takahama, Futtsu (JP); Toshiyuki Shiraishi, Futtsu (JP); Shigeru Ogawa, Futtsu (JP); Luc Vanel, Ogy (FR); Guy Hauret, Fos-sur-Mer (FR); Maxime Laugier, Montigny-les-Metz (FR); Pascal Masson, Metz (FR)

(73) Assignees: Nippon Steel Corporation, Tokyo (JP); Arcelor France, Saint Denis (FR)

( * ) Notice: Subject to any disclaimer, the term of this patent is extended or adjusted under 35 U.S.C. 154(b) by 747 days.

(21) Appl. No.: 11/791,286

(22) PCT Filed: Nov. 17, 2005

(86) PCT No.: PCT/JP2005/021491

§ 371 (c)(1),
(2), (4) Date: Oct. 30, 2007

(87) PCT Pub. No.: WO2006/054777

PCT Pub. Date: May 26, 2006

(65) Prior Publication Data

US 2008/0116011 A1 May 22, 2008

(30) Foreign Application Priority Data

Nov. 22, 2004 (JP) ..... 2004-337307

(51) Int. Cl.
*B21B 27/06* (2006.01)
*B21B 45/02* (2006.01)

(52) U.S. Cl. ..... 72/201; 72/41; 72/43; 72/236

(58) Field of Classification Search ..... 72/38, 39, 72/40, 41, 43, 44, 200, 201, 234, 236, 252.5
See application file for complete search history.

(56) References Cited

U.S. PATENT DOCUMENTS 6,210,501 B1 * 4/2001 Okano et al. ..... 72/39
7,076,983 B2 * 7/2006 Chikushi et al. ..... 72/234
(Continued)

FOREIGN PATENT DOCUMENTS

JP 57-199501 12/1982
(Continued)

OTHER PUBLICATIONS

Korean Office Action dated Aug. 5, 2008 issued in corresponding Korean Application No. 10-2007-7011628.

(Continued)

*Primary Examiner* — David B Jones
(74) *Attorney, Agent, or Firm* — Kenyon & Kenyon LLP

(57) ABSTRACT

The present invention provides a method of supplying lubrication oil in cold rolling for stable rolling without heat scratches or slip and achieving high productivity and improvement of the unit consumption of lubrication oil, that is, a method of supplying lubrication oil in cold rolling by supplying a predetermined kind of emulsion lubrication oil comprised of a mixture of rolling oil and water at the rolling stand inlet from nozzles, the method characterized by measuring or estimating the pressure in the lubrication nozzle pipe (lubrication nozzle pressure), controlling the lubrication nozzle pressure of the rolling stand where lubrication is susceptible to become excessive with the predetermined emulsion lubrication oil to 0.5 MPa or more, and, while doing so, supplying the lubrication oil to the roll bite inlet of the stand by direct injection.

10 Claims, 4 Drawing Sheets

U.S. PATENT DOCUMENTS

| | | | | |
|---|---|---|---|---|
| 7,159,433 | B2 * | 1/2007 | Seidel | 72/201 |
| 7,266,984 | B2 * | 9/2007 | Cerv et al. | 72/236 |
| 7,322,221 | B2 * | 1/2008 | Lohr et al. | 72/44 |
| 7,434,435 | B2 * | 10/2008 | Richter et al. | 72/236 |
| 7,472,574 | B2 * | 1/2009 | Pawelski et al. | 72/201 |
| 2001/0027672 | A1 | 10/2001 | Barten | |

FOREIGN PATENT DOCUMENTS

| | | | |
|---|---|---|---|
| JP | 57-202905 | | 12/1982 |
| JP | 2-151309 | A | 6/1990 |
| JP | 07-9021 | A | 1/1995 |
| JP | 09-276925 | | 10/1997 |
| JP | 10-166012 | | 6/1998 |
| JP | 2001-269710 | A | 10/2001 |

OTHER PUBLICATIONS

European Search Report dated Mar. 4, 2011 issued in corresponding European Application No. 05 80 9292.

* cited by examiner

METHOD OF SUPPLYING LUBRICATION OIL IN COLD ROLLING

TECHNICAL FIELD

The present invention relates to a method of supplying emulsion lubrication oil allowing high productivity and improvement of the unit consumption of oil in a rolling machine for a metal material, in particular cold tandem rolling machines having a group of four or more stands of cold rolling machines.

BACKGROUND ART

In cold tandem rolling by emulsion lubrication, it is known that the emulsion lubrication oil supplied to the rolled material at the stand inlet side or the rolls separates into water and oil, the effect of the wedge shape formed at the roll bite inlet causes the oil to mainly be drawn into the roll bite due to its higher viscosity than the water, and therefore an oil film is formed between the rolls and the rolled material. Note that below, the phenomenon of the lubrication oil supplied to the rolls and the rolled material separating into water and oil and spreading is called "plate-out".

In general, the effect of the wedge shape drawing in the lubrication oil is remarkably improved together with the increase in the rolling speed. Therefore, at a lower speed front stand, the friction coefficient becomes large, while at a higher speed rear stand, the friction coefficient becomes small. If the friction coefficient becomes larger, the possibility of burning flaws called "heat scratches" becomes higher. If the friction coefficient is too small, slip occurs and causes flaws. Therefore, with cold rolling, control of the friction coefficient to a suitable range becomes an important problem.

However, in a single rolling mill performing cold tandem rolling, usually one type of lubrication oil is used (for example, the base oil, emulsion concentration, temperature, etc. are managed to be constant). In the case of a rolling mill having two or more types of lubrication oil tanks, the lubrication base oil, the emulsion concentration, etc. can be changed. For example, a method of selective use of lubrication oils at a front stand and a rear stand etc. can be realized, so it is possible to advantageously control the friction coefficient in cold rolling to a suitable range.

In a rolling mill having only one tank, such selective use of lubrication oils is not possible. Further, newly increasing tanks would require capital investment, so while depending also on the kinds of the rolled products of the rolling mill, sometimes it is difficult to make full use of the capacity of the rolling mill with the current facilities as it and maintain the friction coefficients of all rolling stands in a suitable range for all sorts of rolled products.

Various inventions have been made up until now for solving such problems arising from lubrication of rolling. Note that increasing the friction coefficient can be relatively easily realized both technology and cost wise by decreasing the supply rate of the emulsion lubrication oil or decreasing the emulsion concentration, so in the past mainly methods for increasing the amount of plate-out to decrease the friction coefficient have been developed. Among these, as inventions for controlling the supply pressure etc. of nozzles to decrease the friction coefficient and thereby maintain the friction coefficient in a suitable range, there are the following examples. That is, Japanese Unexamined Patent Publication No. 7-009021 discloses an invention for adding a coagulating agent and setting the nozzle pressure to 5 kg/cm$^2$ to 15 kg/cm$^2$ (0.5 MPa to 1.5 MPa). Further, Japanese Unexamined Patent Publication No. 2001-269710 discloses an invention for setting the particle size of the emulsion and positions of the nozzles along with the nozzle pressure. These inventions, in a word, increase the nozzle pressure and increase the kinetic energy in order to increase the efficiency of friction of the lubrication oil to the rolled material. Further, they are based on the idea that since lubrication oil adhering to the rolled material separates into water and oil and is introduced into the roll bite, if the amount of plate-out to the rolled material increases, the amount of oil introduced also increases.

DISCLOSURE OF THE INVENTION

A schematic view of the suitable range of the friction coefficient in cold rolling of high strength steel sheet (below, called "hi-strength steel sheet"), which is increasing in volume of production in recent years, in comparison with that of ordinary steel sheet is shown in FIG. 1. Hi-strength steel sheet is hard and is susceptible to burning, so at the time of high speed rolling, it is necessary to control the friction coefficient to be smaller so as not giving rise to burning. On the other hand, ordinary steel is less susceptible to burning as compared to hi-strength steel sheet. If overly reducing the friction coefficient at the time of high speed rolling, there is a danger of slip due to excessive lubrication. Therefore, it is necessary to set the friction coefficient greater than with hi-strength steel sheet.

Further, FIG. 2 shows the range of friction coefficient suitable for using conventional lubrication oil in the conventional range of operation based on the inventions described in Japanese Unexamined Patent Publication No. 7-009021 to Japanese Unexamined Patent Publication No. 2001-269710. Conventional lubrication oil is developed in accordance with the conditions of ordinary steel, so as will be understood from the figure, when rolling hi-strength steel sheet, in order to keep the friction coefficient within the range of the friction coefficient of conventional oil, it is necessary to keep the rolling speed down.

The inventors developed a rolling lubrication oil for rolling of hi-strength steel sheet as shown in FIG. 3, but have not been able to realize a suitable range of the friction coefficient for both ordinary steel and hi-strength steel sheet within the operating range. Further, at the time of high speed rolling, approaches to increase the upper limit of the range of friction coefficient so as to realize a friction coefficient suitable for ordinary steel has been sought.

Therefore, under this situation, the present invention has as its object to provide a method of supplying lubrication oil in cold rolling capable of achieving rolling from a low speed region to a high speed region using one type of lubrication oil (base oil, emulsion concentration, and temperature etc. are constant) regardless of the rolled product and in turn capable of avoiding rolling trouble and achieving high productivity and improving the unit consumption of lubrication oil.

In conventional cold tandem rolling, the method of supplying emulsion lubrication oil toward the rolls or rolled material by nozzles is standard. Various inventions have been made for reducing the friction coefficient, but the problem dealt with by the present invention is the excessive lubrication at the time of high speed rolling, therefore means for increasing the friction coefficient have become necessary. The inventors first tried to realize a range of friction coefficient suited to ordinary steel by changing the supply rate among the above-mentioned methods for increasing the friction coefficient. Note that since there is only one lubrication oil tank, changing the emulsion concentration will affect all stands, and therefore it is necessary to avoid any change in concentration. No experiments were conducted either.

It was learned that when reducing the supply rate of the lubrication oil, the friction coefficient increases and can be kept within the suitable range of ordinary steel, but problems arise that the supply of the lubrication oil in the width direction becomes uneven, heat is generated at parts with low supply of lubrication oil and the thermal crown grows partially, and shape disturbances are induced, so the method of changing the supply rate cannot be employed.

The inventors studied the method of increasing the friction coefficient by other methods. As a result, the inventors newly discovered the method of increasing the pipe pressure of the lubrication oil supply nozzles to increase the upper limit of the friction coefficient at the time of high speed rolling. The present invention was made based on this new discovery. Its gist is as follows:

(1) A method of supplying lubrication oil in cold rolling for lubricating rolling in cold tandem rolling of metal sheet by supplying a predetermined kind of an emulsion lubrication oil comprised of a mixture of rolling oil and water at the rolling stand inlet side from nozzles, the method of supplying lubrication oil in cold rolling characterized by measuring or estimating the pressure in the lubrication nozzle pipe (lubrication nozzle pressure), controlling the lubrication nozzle pressure of any rolling stand where lubrication is susceptible to become excessive with the predetermined emulsion lubrication oil to 0.5 MPa or more, and, while doing so, supplying the lubrication oil to the roll bite inlet of the stand by direct injection.

(2) A method of supplying lubrication oil in cold rolling according to (1), characterized by arranging a plurality of lubrication nozzles comprised of pairs of low pressure nozzles and high pressure nozzles for each rolling stand and allowing the lubrication conditions required in accordance with the rolling speed of the rolling stand to be realized with the predetermined emulsion lubrication oil by using either or both of low pressure nozzles and high pressure nozzles for each rolling stand.

(3) A method of supplying lubrication oil in cold rolling according to (1) or (2), characterized by adjusting the number of lubrication nozzles used at the stand so as to cancel out any change in the lubrication oil supply rate accompanying control of the lubrication nozzle pressure.

(4) A method of supplying lubrication oil in cold rolling according to (1) or (2), characterized by using lubrication nozzles able to control the supply rate of the lubrication oil to be constant even when controlling the lubrication nozzle pressure.

(5) A method of supplying lubrication oil in cold rolling according to any one of (1) to (4), characterized by separately controlling the lubrication nozzle pressure at an upper side and a back side of the rolled material constituted by the metal sheet strip.

According to the method of supplying lubrication oil of the present invention, regardless of the rolled product, rolling from the low speed region to the high speed region using one type of lubrication oil can be achieved, rolling trouble can be avoided and high productivity achieved, and the unit consumption of lubrication oil can be improved.

BRIEF DESCRIPTION OF THE DRAWINGS

FIG. 5(*b*) is a plan view schematically showing the state before reduction of the number of nozzles as an example of the method of adjusting the number of nozzles for achieving the rolling method of the present invention by using existing facilities.

BEST MODE FOR WORKING THE INVENTION

Figure 1:
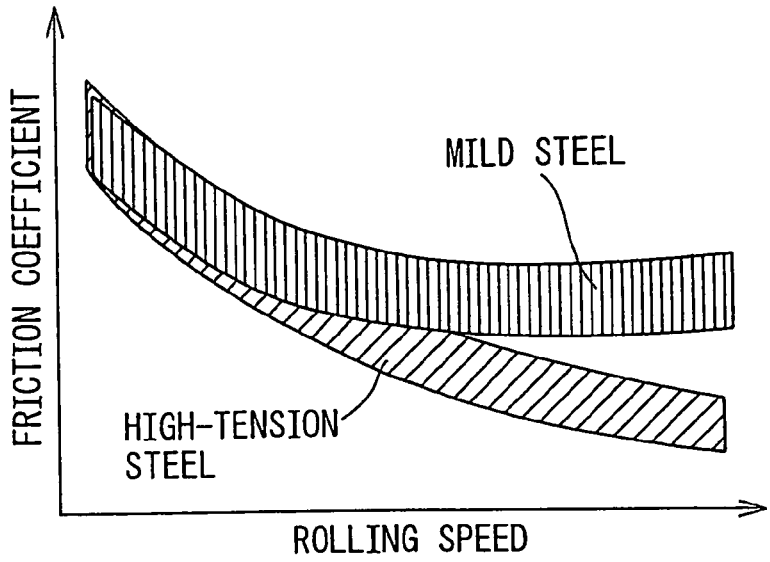
FIG. 1 is a schematic view showing the suitable ranges of the friction coefficients of the hi-strength steel sheet and ordinary steel of typical examples of rolled products.
Figure 2:
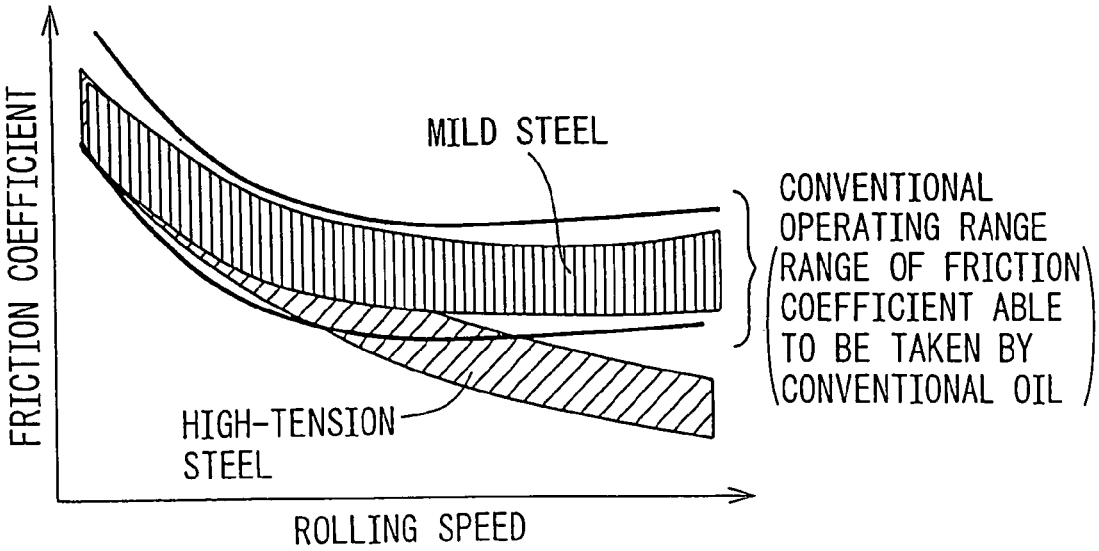
FIG. 2 is a schematic view of the range of friction coefficient suitable for conventional oil in the ordinary operating range and the suitable ranges of friction coefficients of various steels.
Figure 3:
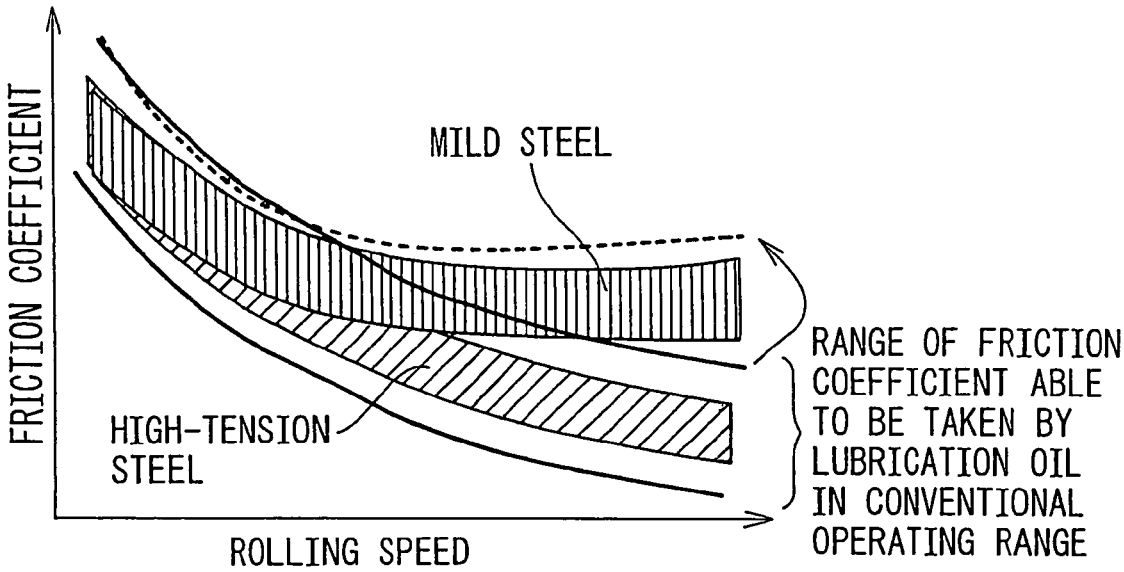
FIG. 3 is a schematic view showing the range of friction coefficient suitable for the ordinary operating range of developed lubrication oil for hi-strength steel sheet and the suitable ranges of friction coefficients of various steels and the upper limit of the friction coefficient at the time of high speed rolling for realizing the same.
Figure 4:
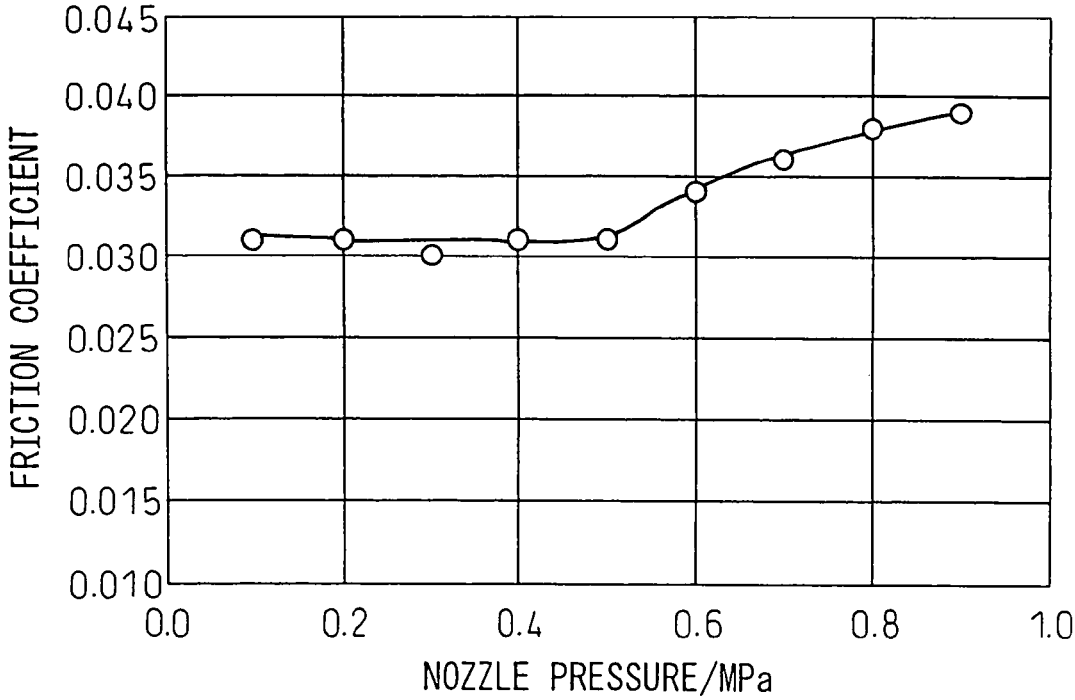
FIG. 4 is a view showing the relationship between the friction coefficient and lubrication nozzle pressure.

The inventors conducted rolling experiments using refined palm oil, and calculated the friction coefficient during rolling. As a result, they learned that even if the supply rate of the lubrication oil is constant, at a high pressure of the conventionally used lubrication nozzle pressure or more, the lubrication nozzle pressure increases and the friction coefficient increases (see FIG. 4). FIG. 4 shows the results of using the refined palm oil, but when a similar experiment was conducted by using animal oils and synthetic esters, while the friction coefficient differed in magnitude, there was almost no change in the pressure where the effect starts, i.e., it was 0.5 MPa or more. Here, the lubrication oil was not supplied independently for the rolled material and the rolls; the method of supplying it by direct injection to the roll bite inlet was employed.

As explained above, it is known that the lubrication oil supplied to the rolls or rolled material separates into water and oil and that the easily separable lubrication oil easily reduces the friction coefficient, and is suitable for high speed rolling. Conversely speaking, by obstructing separation of water and oil, it becomes possible to cause deterioration of the lubrication ability. In practice, it is known that if performing high speed rolling, and depending on the lubrication oil, sometimes the amount of oil introduced is reduced and the friction coefficient is increased. One factor is believed to be that at the time of high speed rolling, turbulence occurs at the oil pool formed at the roll bite inlet causing the amount of oil introduced to the roll bite to decrease. If comparing and studying this discovery and the results of FIG. 4, it is believed that the reason why the friction coefficient increases when keeping the supply rate constant and increasing the lubrication nozzle pressure, is that turbulence occurs at the roll bite inlet and the amount of oil introduced to the roll bite decreases. Based on this, in the present invention, since if no turbulence is caused there is also no reduction in the amount of oil, supplying the lubrication oil by direct injection toward the roll bite inlet becomes an essential condition.

Figure 7:
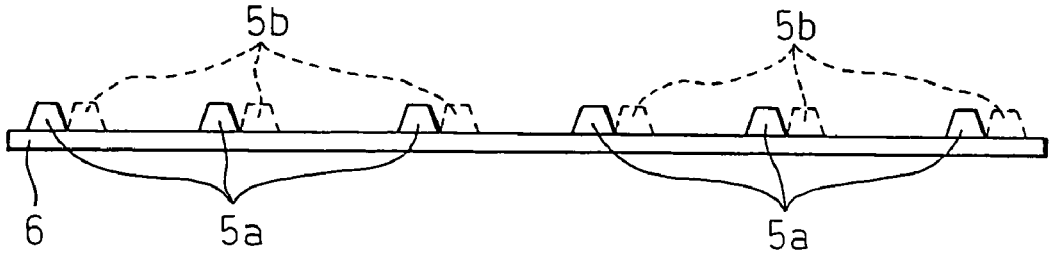
FIG. 7 is a schematic view showing the arrangement of lubrication nozzles arranged as pairs of low pressure nozzles and high pressure nozzles of the present invention.

In the aspect of the present invention described in (2), the provision of a plurality of lubrication nozzles comprised of pairs of two types of nozzles of low pressure nozzles and high pressure nozzles for each rolling stand is employed, and as a result it becomes possible to selectively use the two types of nozzles to satisfy the required lubrication nozzle pressure in accordance with the rolling speed of each rolling stand. FIG. 7 is a view schematically showing an arrangement of lubrication nozzles comprised of pairs of high pressure nozzles 5*a* and low pressure nozzles 5*b*. Here, "low pressure nozzles" indicates nozzles ordinarily used in the past. Further, having the low pressure nozzles and the high pressure nozzles overlap in pressure range at the intermediate pressure region makes the transition smooth at the intermediate pressure region, which is good. In this case, for the intermediate lubrication nozzle pressure, it is possible to use either of, or possible to use both of, the low pressure nozzles and high pressure nozzles to satisfy the required lubrication conditions. According to the aspect of the present invention described in (2), it is sufficient to change only half of the nozzles from the nozzle configuration of the existing rolling facility to high pressure nozzles, thus reducing capital investment.

Figure 5A:
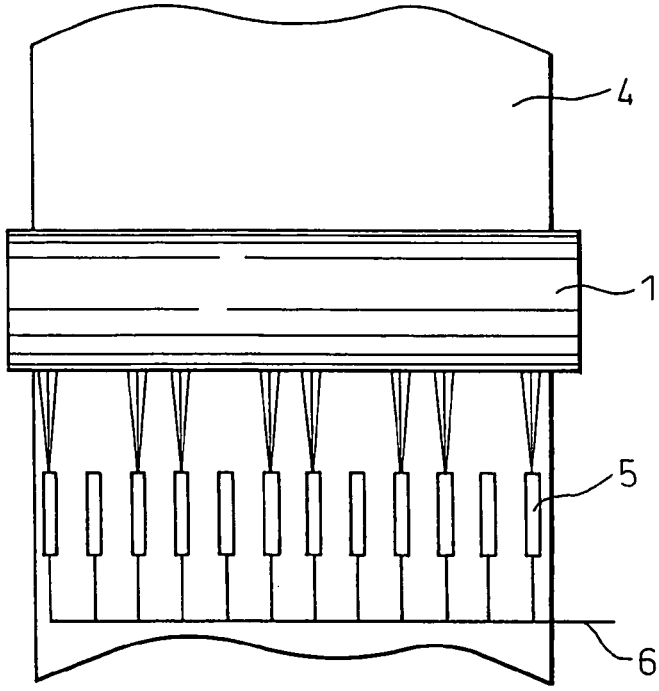
FIG. 5(*a*) is a plan view schematically showing the state of reduction of the number of nozzles as an example of the method of adjusting the number of nozzles for achieving the rolling method of the present invention by using existing facilities.
Figure 5B:
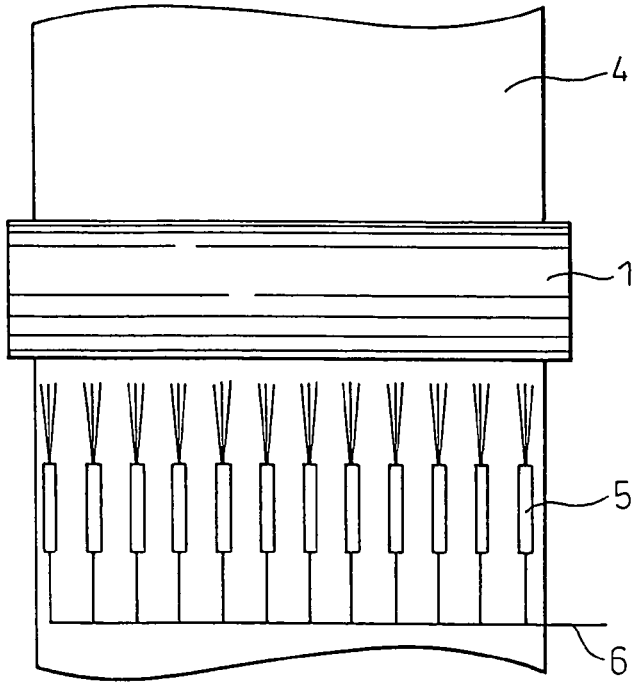

Next, the aspect of the present invention described in (3) will be explained. As explained above, from the discovery of FIG. 4 etc., it is learned that it is possible to increase the lubrication nozzle pressure to lower the lubrication ability and thereby avoid excessive lubrication, but if increasing the lubrication nozzle pressure to increase the supply rate of the lubrication oil, the yield of the lubrication oil deteriorates, which is not preferable. Further, increasing the lubrication oil supply rate improves the lubrication ability, so deterioration of the lubrication ability may be cancelled out. Therefore, even if increasing the nozzle pipe pressure, it is necessary to maintain the supply rate constant. As that means, the method of reducing the number of lubrication nozzles used is employed in the aspect of the present invention described in (3) (see FIG. 5(*a*) and FIG. 5(*b*)). That is, FIG. 5(*a*) and FIG. 5(*b*) show an example of the method of adjusting the number of nozzles for achieving the rolling method described in the aspect of the present invention of (3). FIG. 5(*a*) shows the state of reduction of the number of nozzles, and FIG. 5(*b*) schematically shows the state before reduction of the number of nozzles in plan view, wherein 1 indicates a work roll, 4 a rolled material, 5 a lubrication nozzle, and 6 a lubrication nozzle pipe. Note that usually the number of lubrication nozzles is limited, so only step-wise control is possible, but existing facilities can be used, so capital investment becomes unnecessary and therefore this example can be said to be superior cost wise.

Next, the aspect of the present invention described in (4) will be explained. If investing in capital and using high performance lubrication nozzles, even when changing the lubrication nozzle pressure, it is possible to maintain the supply rate of the lubrication oil constant. In such high performance nozzles, for example, the lubrication nozzle pressure and the amount of supply are determined by the size of the nozzle discharge port, so by using lubrication nozzles enabling free control of the sizes of the nozzle discharge ports on line, it becomes possible to obtain the above effect.

Next, the aspect of the present invention described in (5) will be explained. While lubrication oil is directly sprayed and supplied to the inlet of the roll bite, it sometimes flows down from the roll at the back side of the strip, causing the lubrication to become unequal at the upper and back side of the strip, so controlling the pressure separately at the upper side and back side is a preferred embodiment having a large effect.

In the above way, according to the present invention, it becomes possible to supply lubrication oil to the roll bite at a high pressure, to achieve a suitable friction coefficient without regard as to the rolled product (steel), and to achieve a high productivity and improvement in the unit consumption of oil without rolling trouble.

Note that as the type of metal of the rolled sheet covered by the present invention, in addition to steel, titanium, aluminum, magnesium, copper, or another metal and various alloys of the same may also be used.

EXAMPLES

Example 1

Figure 6:
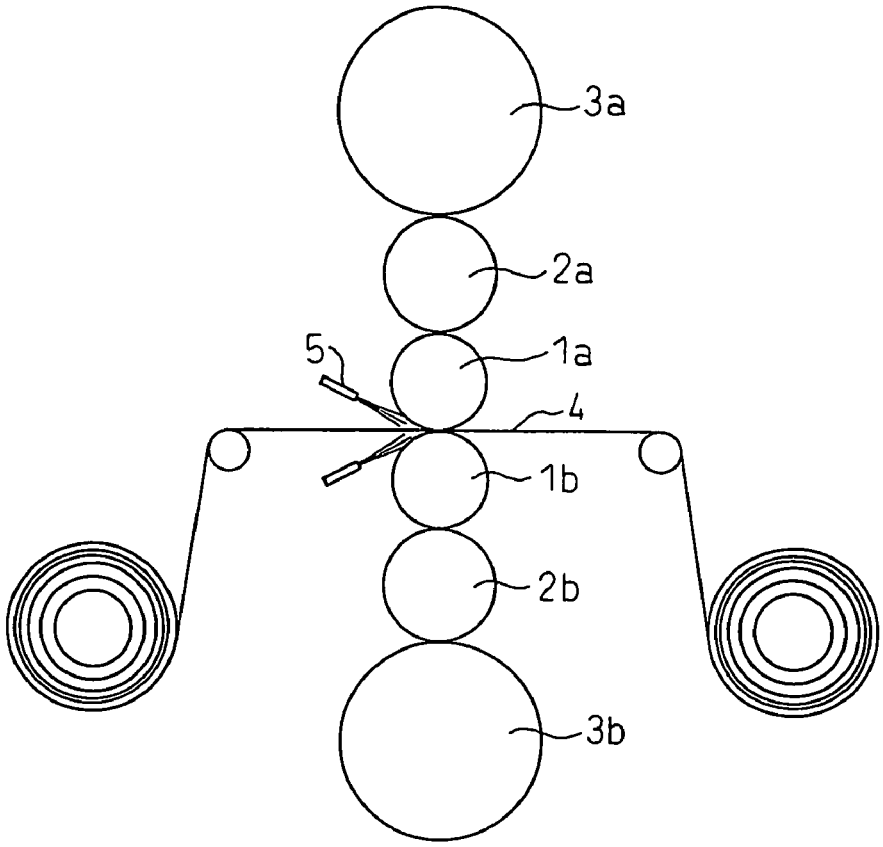
FIG. 6 is a schematic view showing a laboratory rolling machine used in the examples of the present invention.

To confirm the effects of the present invention, the inventors changed the lubrication nozzle pressure and conducted experiments on rolling coils. For the experiment, the laboratory rolling machine shown in FIG. 6 was used. Reference numerals 1*a* and 1*b* indicate work rolls, 2*a* and 2*b* intermediate rolls, and 3*a* and 3*b* backup rolls. Reference numeral 4 indicates a rolled material of a sheet width of 300 mm made of ordinary steel set to a rolling reduction ratio of 11% (sheet thickness reduced from 0.25 mm to 0.2 mm). Reference numeral 5 indicates a lubrication oil supply nozzle, the diameter of the work rolls is 300 mm, the diameter of the intermediate rolls is 360 mm, and the diameter of the backup rolls is 600 mm. The lubrication oil used is a 13% emulsion heated in a tank to 60° C. and based on refined palm oil. The rolling speed was increased from 500 m/min and the operation ended at a maximum rolling speed of 1800 m/min. At a rolling speed of 1200 m/min or less, the lubrication nozzle pressure was set at 0.3 MPa, while at 1200 m/min or more, it was set at 0.8 MPa. At this time, the supply rate of the lubrication oil was about 30 liter/min at 0.3 MPa and about 70 liter/min at 0.8 MPa. After rolling, the sheet was uncoiled and its surface was observed. Further, the inventors calculated the friction coefficient from the actually measured rate of progression and load and confirmed that the friction coefficient decreased somewhat as the speed became higher from about 0.03, but no slip occurred.

Next, as a comparative example, the inventors conducted rolling experiments in the same way in the low speed region without changing the pressure and leaving it at 0.3 MPa and confirmed that slip occurred at a rolling speed of 1500 m/min.

Example 2

To hold the total supply rate constant when changing the lubrication nozzle pressure, the inventors conducted rolling experiments by different lubrication supply methods such as (i) the method of supplying lubrication oil based on reducing the number of nozzles used (see FIG. 5), (ii) the method of supplying lubrication oil based on changing the size of the lubrication oil discharge port of the nozzles when changing the lubrication nozzle pressure, and (iii) the method of supplying lubrication oil using lubrication nozzles comprised of pairs of low pressure nozzles and high pressure nozzles. The other conditions were made to match the conditions of Example 1. In the method of supplying lubrication oil of (i), the inventors investigated the relationship between the lubrication nozzle pressure and supply rate in advance. When increasing the lubrication nozzle pressure, as shown in FIG. 5, they stopped the supply from the nozzles evenly at the left and right sides in the sheet width direction. In the method of supplying lubrication oil of (iii), the low pressure nozzles were made to be used at a pressure of 0.6 MPa or less and the high pressure nozzles were made to be used at a pressure of 0.3 MPa or more. In the intermediate region, the high pressure nozzles were used. In each case, in the same way as the experiment of Example 1 explained above, slip did not occur until 1800 m/min.

Next, as a comparative example, the inventors conducted rolling experiments by the method of supplying lubrication oils (iv) when not changing the number of nozzles used, (v) when not controlling the size of the lubrication oil discharge port of the nozzles, and (vi) when using low pressure nozzles even at a high speed, whereupon in the methods of supplying lubrication oil of (iv) and (v), the unit consumption of lubrication oil deteriorated and 1.2 to 1.4 times the lubrication oil was used. Further, with the method of supplying lubrication oil of (vi), it was only possible to raise the lubrication nozzle pressure to 0.6 MPa, and slip occurred at 1400 m/min.

Example 3

In Examples 1 and 2, examples of control based on the upper side of the rolled material were explained. Here, the inventors controlled the supply of the lubrication oil separately at the upper side and back side of the rolled material by the method of controlling the size of the lubrication oil discharge port of the nozzles for maintaining the lubrication oil supply rate constant under the conditions of Example 2 (ii), that is, changing the lubrication nozzle pressure.

At the back side of the rolled material, the lubrication oil sprayed from the nozzles drops down due to gravity, so lubrication easily becomes insufficient compared with the upper side of the rolled material and slip does not easily occur, so the inventors investigated the range by which the lubrication nozzle pressure and the amount of the unit consumption of lubrication oil can be reduced by (xi) reducing the lubrication nozzle pressure at the back side of the rolled material and (xii) reducing the lubrication nozzle pressure at the back side of the rolled material and reducing the lubrication oil supply rate. As a result, they learned that with the method of supplying lubrication oil of (xi), there is no need for as high a lubrication nozzle pressure as the upper side of the rolled material and the current existing pumps can handle it, and that with the method of supplying lubrication oil of (xii), it is possible to reduce the unit consumption of lubrication oil by 10% compared with the case of Example 2.

The invention claimed is:

1. A method of supplying lubrication oil in cold rolling of a metal sheet by supplying an emulsion lubrication oil comprised of a mixture of rolling oil and water to an inlet of one or more rolling stands from lubrication nozzles, the method characterized by measuring or estimating a lubrication nozzle pressure, controlling the lubrication nozzle pressure of any of said one or more rolling stands to 0.5 MPa or more if lubrication at said one or more rolling stands becomes excessive, and supplying said emulsion lubrication oil to a roll bite inlet of said one or more rolling stands by direct injection, where the lubrication nozzle pressure is the pressure in a lubrication nozzle pipe.

2. A method of supplying lubrication oil in cold rolling according to claim 1, characterized by arranging the lubrication nozzles comprised of pairs of low pressure nozzles and high pressure nozzles for each rolling stand, and adjusting the lubrication nozzle pressure in accordance with a rolling speed of the rolling stand by using either or both of the low pressure nozzles and high pressure nozzles for said rolling stand.

3. A method of supplying lubrication oil in cold rolling according to claim 1, characterized by adjusting number of lubrication nozzles at said one or more rolling stands to maintain a supply rate of said emulsion lubrication oil when adjusting the lubrication nozzle pressure.

4. A method of supplying lubrication oil in cold rolling according to claim 1, characterized by using lubrication nozzles capable of maintaining a constant supply rate of the emulsion lubrication oil when adjusting the lubrication nozzle pressure.

5. A method of supplying lubrication oil in cold rolling according to claim 1, characterized by separately controlling the lubrication nozzle pressure at an upper side and a back side of a rolled material constituted by the metal sheet.

6. A method of supplying lubrication oil in cold rolling according to claim 2, wherein the low pressure nozzles and high pressure nozzles overlap in pressure range at an intermediate pressure region.

7. A method of supplying lubrication oil in cold rolling according to claim 4, wherein the lubrication nozzles maintain a constant supply rate of the lubricant by controlling the size of a discharge port of the nozzle.

8. A method of supplying lubrication oil in cold rolling according to claim 5, wherein the pressure of lubrication nozzles for the back side of the rolled material is reduced.

9. A method of supplying lubrication oil in cold rolling according to claim 8, wherein a supply rate of the lubricant is reduced.

10. A method of supplying lubrication oil in cold rolling according to claim 1, wherein said one or more rolling stands comprises a group of four or more rolling stands of a cold tandem rolling machine.

* * * * *